US009383689B1

(12) United States Patent
Ikeda et al.

(10) Patent No.: US 9,383,689 B1
(45) Date of Patent: Jul. 5, 2016

(54) IMAGE FORMING APPARATUS THAT TRANSFERS A FIRST IMAGE FORMED USING A TONER CONTAINING A PIGMENT OTHER THAN A FLAT PIGMENT AND THAT TRANSFERS A SECOND IMAGE FORMED USING A TONER CONTAINING A FLAT PIGMENT

(71) Applicant: FUJI XEROX CO., LTD., Tokyo (JP)

(72) Inventors: Miho Ikeda, Kanagawa (JP); Koichiro Yuasa, Kanagawa (JP); Yoshiyuki Tominaga, Kanagawa (JP); Kenji Sawai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/833,536

(22) Filed: Aug. 24, 2015

(30) Foreign Application Priority Data

Feb. 25, 2015 (JP) ..... 2015-035794

(51) Int. Cl.
*G03G 15/16* (2006.01)
*G03G 15/01* (2006.01)

(52) U.S. Cl.
CPC ..... *G03G 15/16* (2013.01); *G03G 15/0131* (2013.01); *G03G 15/1665* (2013.01)

(58) Field of Classification Search
CPC ..... G03G 15/0161; G03G 15/0142; G03G 15/0178; G03G 15/16; G03G 15/1605; G03G 15/1665; G03G 15/167; G03G 2215/16
USPC ..... 399/66, 299, 302, 82
See application file for complete search history.

(56) References Cited

U.S. PATENT DOCUMENTS

2013/0243462 A1* 9/2013 Ono ..... G03G 15/1605 399/66
2014/0356035 A1* 12/2014 Harashima ..... G03G 15/2039 399/321
2015/0192872 A1* 7/2015 Noguchi ..... G03G 9/0902 430/105
2015/0205229 A1* 7/2015 Hara ..... G03G 15/1605 399/299
2015/0212458 A1* 7/2015 Nakajima ..... G03G 15/1675 399/313
2015/0220025 A1* 8/2015 Tominaga ..... G03G 15/1605 399/66

FOREIGN PATENT DOCUMENTS

JP 2006-317632 A 11/2006

* cited by examiner

*Primary Examiner* — Sophia S Chen
(74) *Attorney, Agent, or Firm* — Sughrue Mion, PLLC

(57) ABSTRACT

An image forming apparatus includes a first forming unit that forms a first image by using a toner that contains a pigment other than a flat pigment; a second forming unit that forms a second image by using a toner that contains a flat pigment; a transfer body that transports the first image and the second image transferred thereon and transfers the first image and the second image onto a recording medium; a first transfer member that nips the transfer body in cooperation with the first forming unit with a first load and transfers the first image from the first forming unit onto the transfer body; and a second transfer member that nips the transfer body in cooperation with the second forming unit with a second load, which is larger than the first load, and transfers the second image from the second forming unit onto the transfer body.

4 Claims, 9 Drawing Sheets

IMAGE FORMING APPARATUS THAT TRANSFERS A FIRST IMAGE FORMED USING A TONER CONTAINING A PIGMENT OTHER THAN A FLAT PIGMENT AND THAT TRANSFERS A SECOND IMAGE FORMED USING A TONER CONTAINING A FLAT PIGMENT

CROSS-REFERENCE TO RELATED APPLICATIONS

This application is based on and claims priority under 35 USC 119 from Japanese Patent Application No. 2015-035794 filed Feb. 25, 2015.

BACKGROUND

Technical Field

The present invention relates to image forming apparatuses.

SUMMARY

According to an aspect of the invention, there is provided an image forming apparatus including a first forming unit, a second forming unit, a transfer body, a first transfer member, and a second transfer member. The first forming unit forms a first image by using a toner that contains a pigment other than a flat pigment. The second forming unit forms a second image by using a toner that contains a flat pigment. The transfer body transports the first image and the second image transferred thereon and transfers the first image and the second image onto a recording medium. The first transfer member nips the transfer body in cooperation with the first forming unit with a first load and transfers the first image from the first forming unit onto the transfer body. The second transfer member nips the transfer body in cooperation with the second forming unit with a second load, which is larger than the first load, and transfers the second image from the second forming unit onto the transfer body.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings. In each of the drawings, an arrow H indicates the vertical direction, and an arrow W indicates an apparatus width direction, which is the horizontal direction.

First Exemplary Embodiment

Configuration of Image Forming Apparatus 10

Figure 1:
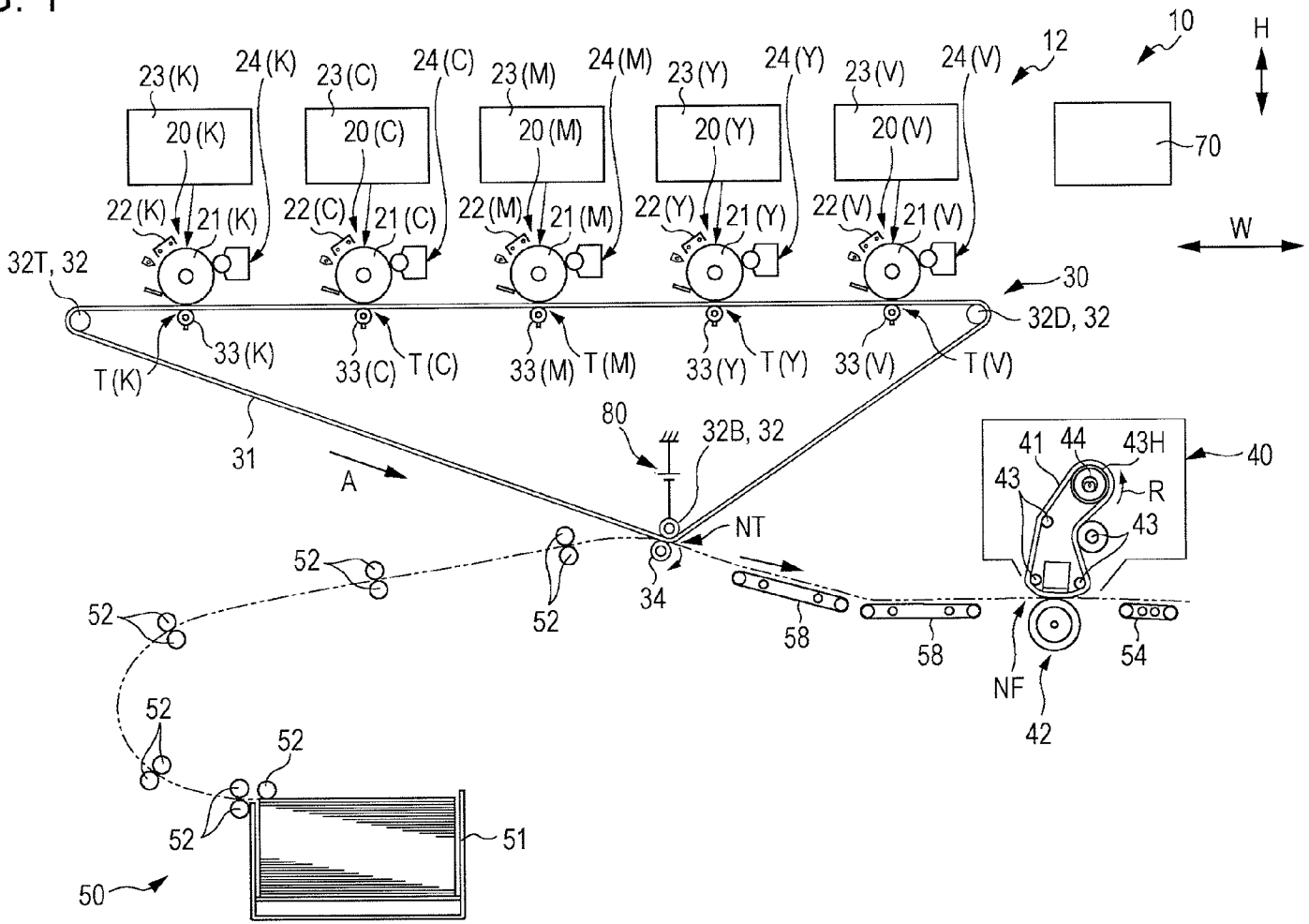
FIG. 1 schematically illustrates the configuration of an image forming apparatus according to a first exemplary embodiment.

FIG. 1 schematically illustrates the configuration of an image forming apparatus 10, as viewed from the front side. As shown in FIG. 1, the image forming apparatus 10 includes an image forming section 12 that forms an image onto a recording medium P, such as a sheet, by electrophotography, a transport device 50 that transports the recording medium P, and a controller 70 that controls the operation of each section of the image forming apparatus 10.

Transport Device 50

As shown in FIG. 1, the transport device 50 includes a container 51 that accommodates recording media P, and multiple transport rollers 52 that transport each recording medium P from the container 51 to a second-transfer position NT. Moreover, the transport device 50 includes multiple transport belts 58 that transport the recording medium P from the second-transfer position NT to a fixing device 40, and a transport belt 54 that transports the recording medium P from the fixing device 40 to an output section (not shown) for the recording medium P.

Image Forming Section 12

The image forming section 12 includes toner-image forming units 20 that form toner images, a transfer device 30 that transfers the toner images formed by the toner-image forming units 20 onto the recording medium P, and the fixing device 40 that applies heat and pressure onto the toner images transferred on the recording medium P so as to fix the toner images onto the recording medium P.

The multiple toner-image forming units 20 are provided so as to form toner images of multiple colors. In this exemplary embodiment, five toner-image forming units 20 for five respective colors, namely, yellow (Y), magenta (M), cyan (C), black (K), and a special color (V), are provided. These toner-image forming units 20 are arranged from the upstream side toward the downstream side in a transporting direction of a transfer belt 31 to be described later in the following order: special color (V), yellow (Y), magenta (M), cyan (C), black (K).

The image forming section 12 is equipped with the yellow (Y), magenta (M), cyan (C), and black (K) toner-image forming units 20 as standard units, and the yellow (Y), magenta (M), cyan (C), and black (K) colors are the standard colors. The special-color (V) toner-image forming unit 20 is, for example, an additional toner-image forming unit 20 provided as an optional unit.

The reference characters (V), (Y), (M), (C), and (K) shown in FIG. 1 denote components corresponding to the respective colors. In this description, the parentheses of (V), (Y), (M), (C), and (K) may sometimes be omitted so as to be indicated simply as V, Y, M, C, and K. For the special color (V), for example, silver color or gold color is used. As will be described later, this exemplary embodiment relates to an example in which a silver-color toner containing a flat pigment is used as the special-color (V) toner. Alternatively, the toner containing the flat pigment may contain a pigment other than the flat pigment.

Toner-Image Forming Units 20

Figure 2:
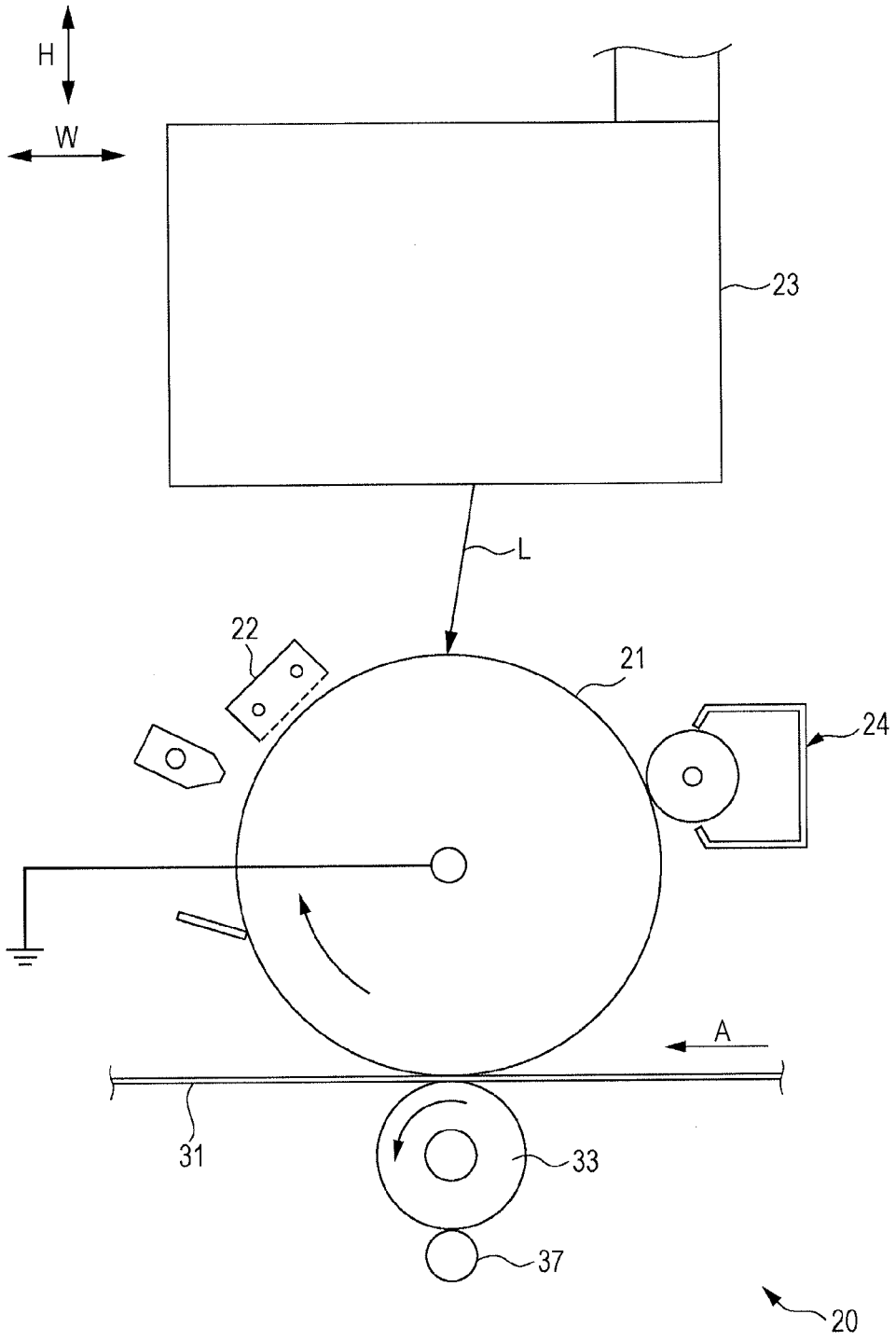
FIG. 2 schematically illustrates a toner-image forming unit according to the first exemplary embodiment.

The toner-image forming units 20 for the respective colors basically have the same configuration except that they use different toners. Specifically, as shown in FIG. 2, each toner-image forming unit 20 includes a photoconductor drum 21 that rotates clockwise in FIG. 2, and a charging device 22 that electrostatically charges the photoconductor drum 21. Furthermore, each toner-image forming unit 20 includes an exposure device 23 that forms an electrostatic latent image on the photoconductor drum 21 by exposing the photoconductor drum 21 electrostatically charged by the charging device 22 to light L, and a developing device 24 that forms a toner image by developing the electrostatic latent image formed on the photoconductor drum 21 by the exposure device 23.

Specifically, the exposure device 23 forms the electrostatic latent image on the photoconductor drum 21 by radiating exposure light modulated according to image data acquired by the controller 70 onto the photoconductor drum 21. This electrostatic latent image is developed by the developing device 24 so that a toner image based on the image data is formed. The image data acquired by the controller 70 is, for example, image data generated by an external apparatus (not shown) and acquired from the external apparatus.

Transfer Device 30

The transfer device 30 superimposes and first-transfers the toner images on the respective photoconductor drums 21 onto the transfer belt 31 (intermediate transfer body) and then second-transfers the superimposed toner images onto the recording medium P at the second-transfer position NT. Specifically, as shown in FIG. 1, the transfer device 30 includes the transfer belt 31 as an example of a transfer body that has the toner images transferred thereon and transfers the toner images onto the recording medium P; first-transfer rollers 33; and a second-transfer roller 34.

Transfer Belt 31

As shown in FIG. 1, the transfer belt 31 is an endless belt whose orientation is set by being wrapped around multiple rollers 32. In this exemplary embodiment, the transfer belt 31 in front view has an inverted obtuse triangular shape that is long in the apparatus width direction. The multiple rollers 32 include a roller 32D shown in FIG. 1 that functions as a driving roller that is driven by a motor (not shown) so as to rotate the transfer belt 31 in a direction indicated by an arrow A. The transfer belt 31 rotates in the direction of the arrow A so as to transport the first-transferred toner images from first-transfer positions T to the second-transfer position NT.

Furthermore, the multiple rollers 32 include a roller 32T shown in FIG. 1 that functions as a tension applying roller that applies tension to the transfer belt 31. The multiple rollers 32 also include a roller 32B shown in FIG. 1 that functions as an opposing roller 32B that is opposed to the second-transfer roller 34. The lower apex of the obtuse angle of the transfer belt 31 oriented in the aforementioned inverted obtuse triangular shape is wrapped along the opposing roller 32B. With regard to the transfer belt 31 oriented in the above-described manner, the upper side thereof extending in the apparatus width direction is in contact with the photoconductor drums 21 from below.

First-Transfer Rollers 33

The first-transfer rollers 33 transfer the toner images on the photoconductor drums 21 onto the transfer belt 31 and are disposed within the transfer belt 31. Each first-transfer roller 33 is disposed opposite the corresponding photoconductor drum 21 with the transfer belt 31 interposed therebetween. Each first-transfer roller 33 is supplied with first-transfer voltage (first-transfer current) with a reversed polarity relative to a toner polarity from a corresponding electricity feeder 37 (see FIG. 2). Thus, a transfer electric field is generated between the photoconductor drum 21 of each toner-image forming unit 20 and the corresponding first-transfer roller 33, so that an electrostatic force acts on the toner image formed on the photoconductor drum 21, whereby the toner image is transferred onto the transfer belt 31 at the corresponding first-transfer position T.

Second-Transfer Roller 34

The second-transfer roller 34 transfers the toner images superimposed on the transfer belt 31 onto the recording medium P. As shown in FIG. 1, the second-transfer roller 34 is disposed opposite the opposing roller 32B with the transfer belt 31 interposed therebetween, and the second-transfer roller 34 and the transfer belt 31 are in contact with each other with a predetermined load. The second-transfer position NT is formed between the second-transfer roller 34 and the transfer belt 31 that are in contact with each other in this manner. A recording medium P is supplied to this second-transfer position NT from the container 51 on a timely basis. The second-transfer roller 34 is rotationally driven clockwise in FIG. 1.

With regard to the second-transfer roller 34, negative-polarity voltage is applied to the opposing roller 32B by an electricity feeder 80 so that a potential difference occurs between the opposing roller 32B and the second-transfer roller 34. Specifically, by applying negative-polarity voltage to the opposing roller 32B, the second-transfer roller 34 serving as a counter-electrode for the opposing roller 32B is indirectly supplied with second-transfer voltage (positive-polarity voltage) with a reversed polarity relative to the toner polarity. Thus, a transfer electric field is generated between the opposing roller 32B and the second-transfer roller 34, so that an electrostatic force acts on the toner images on the transfer belt 31, whereby the toner images become transferred from the transfer belt 31 to the recording medium P passing through the second-transfer position NT.

Fixing Device

The fixing device 40 applies heat and pressure to the toner images at a fixation nip NF formed between a pressing roller 42 and a fixing belt 41 wrapped around multiple rollers 43 so as to fix the toner images onto the recording medium P.

The rollers 43 include, for example, a roller 43H serving as a driving roller. The roller 43H is rotationally driven so as to rotate the fixing belt 41 in a direction indicated by an arrow R.

A heat source 44, such as a halogen lamp, is provided inside the roller 43H. The heat source 44 heats the fixing belt 41 via the roller 43H.

In accordance with a driving force transmitted from a motor (not shown), the pressing roller 42 rotates at a peripheral speed equal to the peripheral speed of the fixing belt 41.

Configuration of Relevant Parts

As described above, in this exemplary embodiment, the toner-image forming units 20Y, 20M, 20C, and 20K (examples of first forming units) form toner images (examples of first images) by using yellow (Y), magenta (M), cyan (C), and black (K) toners, respectively (see FIG. 1).

The yellow (Y), magenta (M), cyan (C), and black (K) toners used in the respective toner-image forming units 20Y, 20M, 20C, and 20K (denoted as "20Y to 20K" hereinafter) do not contain flat pigments but contain pigments (e.g., organic pigments or inorganic pigments) other than flat pigments, as well as binder resin. These pigments each have a shape similar to a spherical shape, as compared with a pigment 110 in a silver-color toner to be described later.

For the sake of convenience, in this description, the yellow (Y), magenta (M), cyan (C), and black (K) colors will be referred to as "colors", the toners with these colors will be referred to as "color toners", and toner images formed by using these color toners will be referred to as "color images".

On the other hand, the toner-image forming unit 20V (an example of a second forming unit) forms a toner image (an example of a second image) by using a silver-colored toner (referred to as "silver-color toner" hereinafter) as the special color (V) (see FIG. 1). For the sake of convenience, a toner image formed by using the silver-color toner will be referred to as "silver-color image".

Figure 3B:
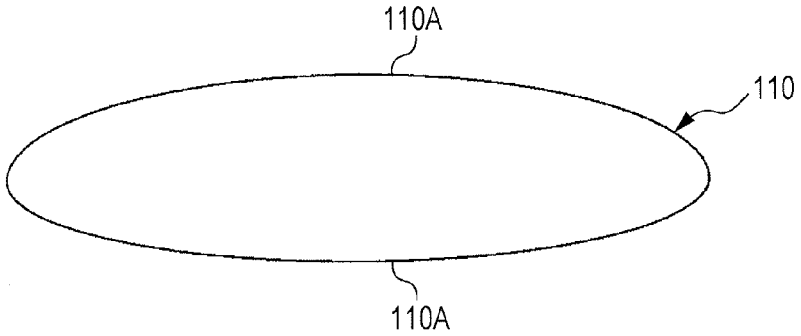
Figure 4A:
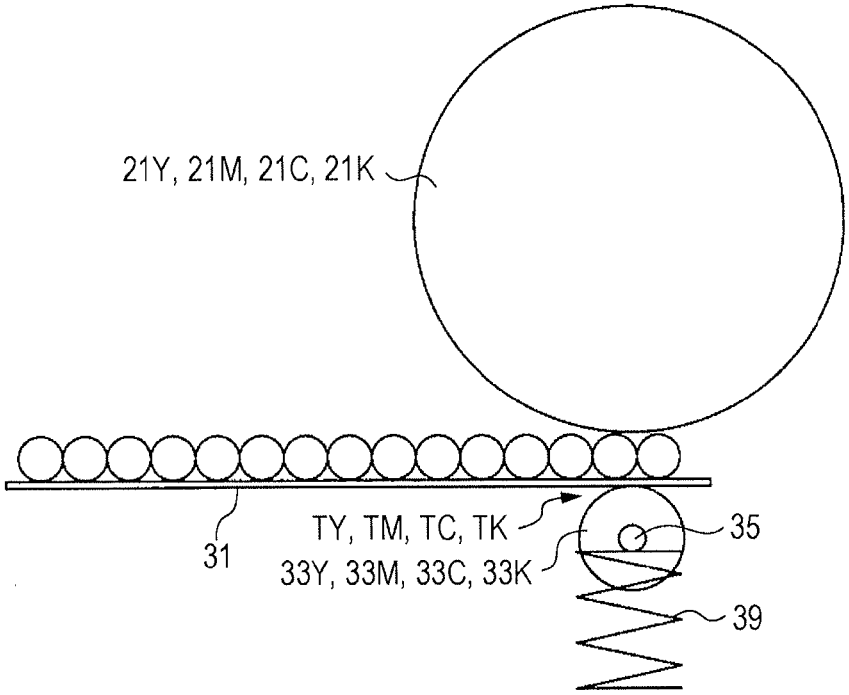
FIGS. 4A and 4B schematically illustrate a state where a transfer belt is nipped between a first-transfer roller and a photoconductor drum.
Figure 4B:
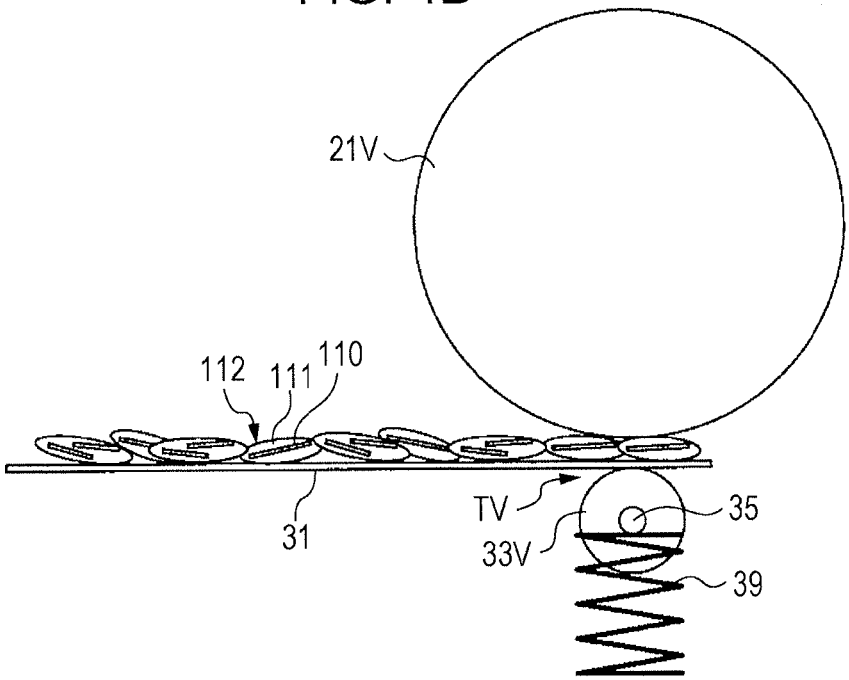

As shown in FIG. 4B, a silver-color toner 112 used in the toner-image forming unit 20V contains the pigment 110, as an example of a flat pigment, and binder resin 111. The pigment 110 is composed of metal, such as aluminum. As shown in FIG. 3B, when the pigment 110 is placed on a flat surface and is viewed from the side, the pigment 110 is longer in the left-right direction than in the up-down direction. The dimensional ratio of the dimension of the pigment 110 in the left-right direction to the dimension thereof in the up-down direction is larger than the dimension ratio with respect to the pigment in each color toner. Furthermore, the silver-color toner 112 has a particle diameter that is larger than that of each color toner. Specifically, an average volume particle diameter of each color toner is about, for example, 4 μm to 6 μm, whereas an average volume particle diameter of the silver-color toner 112 is about, for example, 10 μm.

Figure 3A:
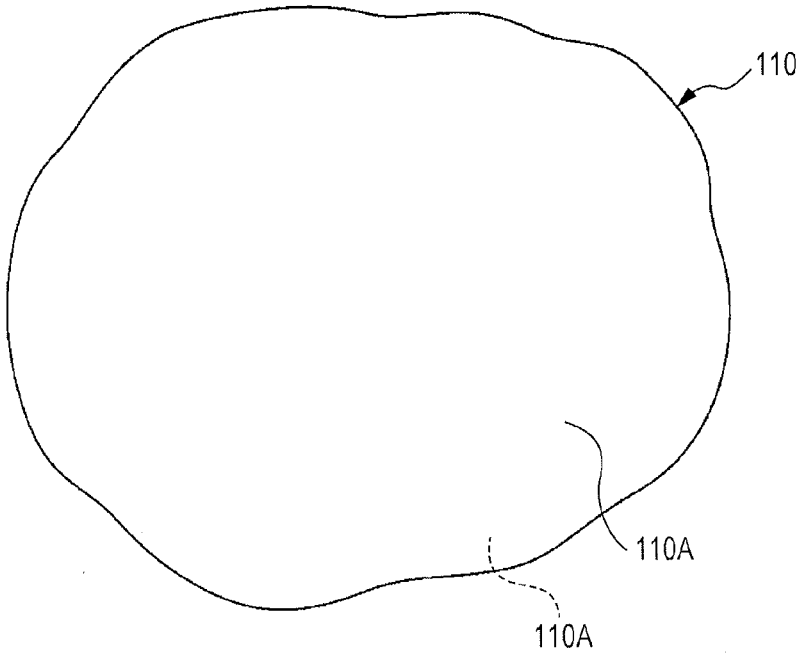
FIGS. 3A and 3B are a plan view and a side view of a flat pigment.

When the pigment 110 shown in FIG. 3B is viewed from above, the pigment 110 has an expanded shape, as shown in FIG. 3A, relative to the shape thereof as viewed from the side. In a state where the pigment 110 is placed on a flat surface (see FIG. 3B), the pigment 110 has a pair of reflective surfaces 110A that face upward and downward. Accordingly, the pigment 110 has a flat shape. The silver-color toner has a flat shape that conforms to the shape of the pigment 110.

In this exemplary embodiment, the controller 70 receives job data together with an image formation command from an external apparatus (not shown).

The job data includes image data for causing the toner-image forming units 20V and 20Y to 20K to form toner images, as well as other data that accompanies the image data. The other data includes, for example, the size of the recording medium P onto which an image is to be formed (i.e., the width of the recording medium P in a direction intersecting the transport direction). The image data includes area-coverage (%) data for forming an image, as well as image-width data.

Examples of the image formation command include a silver-color-image formation command, a color-image formation command, and a mixed-color-image formation command. The silver-color-image formation command is an image formation command for forming a silver-color image on the recording medium P without forming color images on the recording medium P. The color-image formation command is an image formation command for forming color images on the recording medium P without forming a silver-color image on the recording medium P. The mixed-color-image formation command is an image formation command for forming a silver-color image and color images on the recording medium P.

An image formation command for forming a silver-color image on the recording medium P includes the aforementioned silver-image formation command and the aforementioned mixed-color-image formation command. An image formation command for forming color images on the recording medium P includes the aforementioned color-image formation command and the aforementioned mixed-color-image formation command.

As shown in FIG. 4A, in this exemplary embodiment, each of the first-transfer rollers 33Y, 33M, 33C, and 33Y (denoted as "33Y to 33K" hereinafter) has a shaft 35 that is pressed with a first nip load (an example of a first load) toward the corresponding one of the photoconductor drums 21Y, 21M, 21C, and 21K (denoted as "21Y to 21K" hereinafter) by a compression spring 39. Thus, the first-transfer rollers 33Y to 33K (examples of first transfer members) and the photoconductor drums 21Y to 21K nip the transfer belt 31 with the first nip load.

In this state, the first-transfer rollers 33Y to 33K transfer the color images from the photoconductor drums 21Y to 21K onto the transfer belt 31 at the respective first-transfer positions TY, TM, TC, and TK. The first nip load is set to, for example, 13 g/cm (linear pressure). The first nip load may be set in a range between 8 g/cm and 20 g/cm (but excluding 13 g/cm).

As shown in FIG. 4B, the first-transfer roller 33V has a shaft 35 that is pressed with a second nip load, which is larger than the first nip load, toward the photoconductor drum 21V by a compression spring 39. Thus, the first-transfer roller 33V (an example of a second transfer member) and the photoconductor drum 21V nip the transfer belt 31 with the second nip load (an example of a second load) that is larger than the first nip load. In this state, the first-transfer roller 33V transfers the silver-color image from the photoconductor drum 21V onto the transfer belt 31 at the first-transfer position TV.

The second nip load is set to be larger than the first nip load by setting (adjusting) any one of or a combination of the diameter, the material, and the compression amount of the compression spring 39. The second nip load is set to, for example, 17 g/cm (linear pressure). The second nip load may be set in a range between 13 g/cm and 25 g/cm (but excluding 17 g/cm) so long as the second nip load is larger than the first nip load.

Operation of Relevant Parts

Next, the operation of the relevant parts will be described.

When the controller 70 receives an image formation command for forming a silver-color image on the recording medium P, the controller 70 activates the toner-image forming unit 20V (see FIG. 1). Thus, in the toner-image forming unit 20V, a charging operation, an exposure operation, and a developing operation are performed by the charging device 22, the exposure device 23, and the developing device 24, respectively, so that a silver-color image is formed on the photoconductor drum 21V.

This silver-color image is transferred onto the transfer belt 31 at the first-transfer position TV. In this case, the silver-color image and the transfer belt 31 are nipped with the second nip load between the first-transfer roller 33V and the photoconductor drum 21V at the first-transfer position TV. The silver-color image transferred on the transfer belt 31 is transferred onto the recording medium P from the transfer belt 31 at the second-transfer position NT.

The recording medium P having the silver-color image transferred thereon is transported to the fixation nip NF of the fixing device 40. The fixing device 40 applies heat and pressure onto the recording medium P passing through the fixation nip NF. Thus, the silver-color image transferred on the recording medium P becomes fixed onto the recording medium P.

As described above, in the first exemplary embodiment, when the silver-color image is to be transferred onto the transfer belt 31, the silver-color image and the transfer belt 31 are nipped with the second nip load, which is larger than the first nip load. Therefore, the silver-color toner particles in the silver-color image become closely in contact with one another in a laid state and clump together, as compared with a case where the silver-color image and the transfer belt 31 are nipped with the first nip load. Moreover, the contact area between the silver-color toner in the silver-color image and the transfer belt 31 increases, so that the adhesion strength (adhesiveness) between the silver-color toner and the transfer belt 31 increases, as compared with a case where the silver-color image and the transfer belt 31 are nipped with the first nip load.

Figure 5:
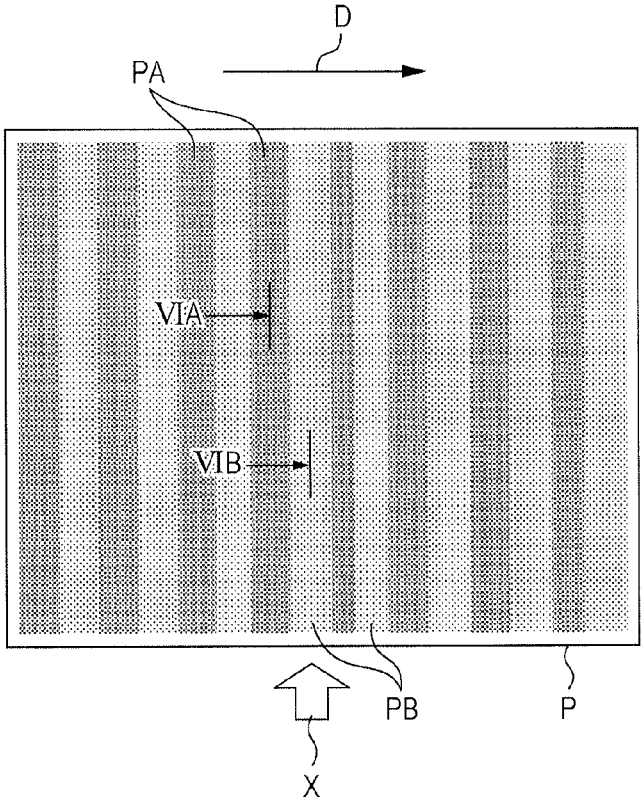
FIG. 5 illustrates nonuniform alignment (nonuniform metallic luster) of the flat pigment in an image formed on a recording medium.

When the silver-color image is to be transferred onto the recording medium P from the transfer belt 31, for example, if the second-transfer roller 34 vibrates in the axial direction thereof, the silver-color image is transferred onto the recording medium P while the recording medium P moves relative to the transfer belt 31 alternately from one side to the other side of the second-transfer roller 34 in the axial direction. As a result, the orientation of the pigment 110 of the silver-color toner in the transferred silver-color image changes in accordance with the vibration period. Due to this periodical change in the orientation of the pigment 110, a periodical variation in the orientation of the pigment 110 occurs in the fixed silver-color image. In other words, nonuniform alignment of the pigment 110 occurs in the fixed silver-color image, as shown in FIG. 5. When such nonuniform alignment of the pigment 110 occurs, metallic luster visually recognized by reflection light from the pigment 110 becomes nonuniform.

Figure 6A:
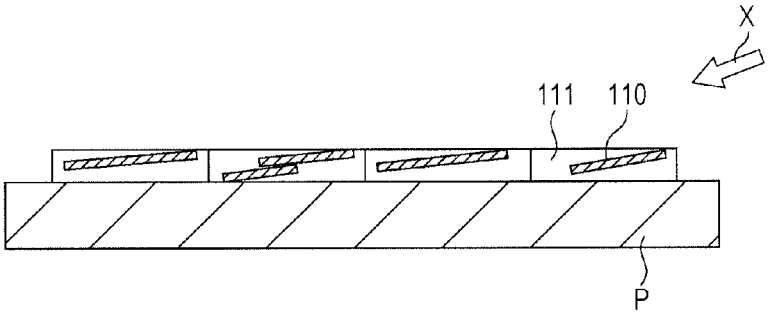
FIG. 6A is a cross-sectional view taken along an arrow VIA in FIG. 5.
Figure 6B:
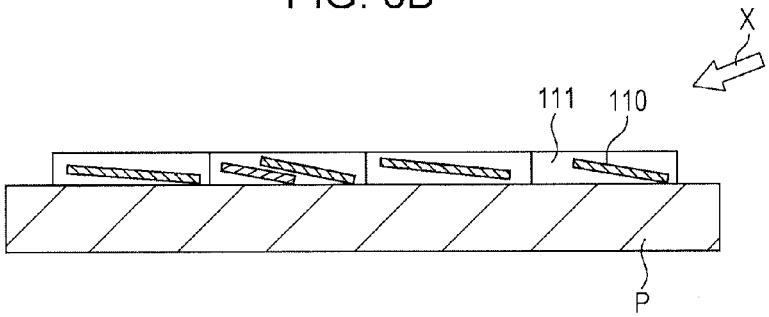
FIG. 6B is a cross-sectional view taken along an arrow VIB in FIG. 5.

In the example shown FIG. 5, dark segments PA and bright segments PB extending in the form of strips in a direction intersecting a transport direction D of the recording medium P create an alternating nonuniform pattern in the transport direction D. This nonuniform pattern is visually recognizable when viewed from a direction indicated by an arrow X in FIG. 5. Specifically, as shown in FIG. 6A, in the dark segments PA, the pigment 110 is oriented in a visually-recognizable direction X and reflection light toward the visually-recognizable side is relatively low. In contrast, in the bright segments PB, as shown in FIG. 6B, the pigment 110 is oriented to face the visually-recognizable direction X and reflection light toward the visually-recognizable side is relatively high. FIG. 6A is a schematic cross-sectional view taken along an arrow VIA in FIG. 5, and FIG. 6B is a schematic cross-sectional view taken along an arrow VIB in FIG. 5.

In contrast, in this exemplary embodiment, the silver-color image is transferred onto the transfer belt 31 in a state where the silver-color image and the transfer belt 31 are nipped with the second nip load, which is larger than the first nip load, as described above. Thus, the silver-color toner particles clump together in a laid state, and the adhesion strength (adhesiveness) between the silver-color toner and the transfer belt 31 increases. Therefore, when the silver-color image is to be transferred onto the recording medium P from the transfer belt 31, even if the second-transfer roller 34 vibrates in the axial direction thereof, the pigment 110 of the silver-color toner may be less likely to move, so that a local change in the orientation of the pigment 110 may be less likely to occur.

Consequently, a periodical variation in the orientation of the pigment 110 contained in the silver-color toner of the silver-color image transferred on the recording medium P from the transfer belt 31 may be suppressed, as compared with a case where the nip load at the first-transfer position TV is smaller than or equal to the first nip load. Thus, nonuniform metallic luster may be suppressed in the silver-color image formed on the recording medium P.

When the controller 70 receives an image formation command for forming color images on the recording medium P, the controller 70 activates the toner-image forming units 20Y to 20K (see FIG. 1). Thus, in the toner-image forming units 20Y to 20K, a charging operation, an exposure operation, and a developing operation are performed by the charging devices 22, the exposure devices 23, and the developing devices 24, respectively, so that color images are formed on the photoconductor drums 21Y to 21K.

These color images are sequentially transferred onto the transfer belt 31 at the first-transfer positions TY to TK. In this case, the color images and the transfer belt 31 are nipped with the first nip load between the first-transfer rollers 33Y to 33K and the photoconductor drums 21Y to 21K at the first-transfer positions TY to TK. The color images transferred on the transfer belt 31 are transferred onto the recording medium P from the transfer belt 31 at the second-transfer position NT.

The recording medium P having the color images transferred thereon is transported to the fixation nip NF of the fixing device 40. The fixing device 40 applies heat and pressure onto the recording medium P passing through the fixation nip NF. Thus, the color images transferred on the recording medium P become fixed onto the recording medium P.

As described above, in the first exemplary embodiment, when the color images are to be transferred onto the transfer belt 31, the color images and the transfer belt 31 are nipped with the first nip load, which is smaller than the second nip load. Therefore, the color toner particles in the color images do not become closely in contact with one another and may be prevented from clumping together on the transfer belt 31, as compared with a case where the color images and the transfer belt 31 are nipped with the second nip load. Moreover, the adhesion strength (adhesiveness) between the color toners of the color images and the transfer belt 31 is lower than in a case where the color images and the transfer belt 31 are nipped with the second nip load.

Therefore, when the color images are transferred onto the recording medium P from the transfer belt 31, a situation where the color toners remain on the transfer belt 31 without being transferred onto the recording medium P may be suppressed, so that missing images on the recording medium P may be suppressed.

Modification of First Exemplary Embodiment

In the first exemplary embodiment, the first-transfer rollers 33Y to 33K and 33V are pressed toward the photoconductor drums 21Y to 21K and 21V by the compression springs 39. Alternatively, for example, the first-transfer rollers 33Y to 33K and 33V may be pressed toward the photoconductor drums 21Y to 21K and 21V by other types of spring members, such as tension springs, or other elastic members.

Second Exemplary Embodiment

Next, an image forming apparatus according to a second exemplary embodiment will be described. Components similar to those in the first exemplary embodiment will be given the same reference characters, and descriptions thereof will be omitted.

Configuration of Second Exemplary Embodiment

Figure 7:
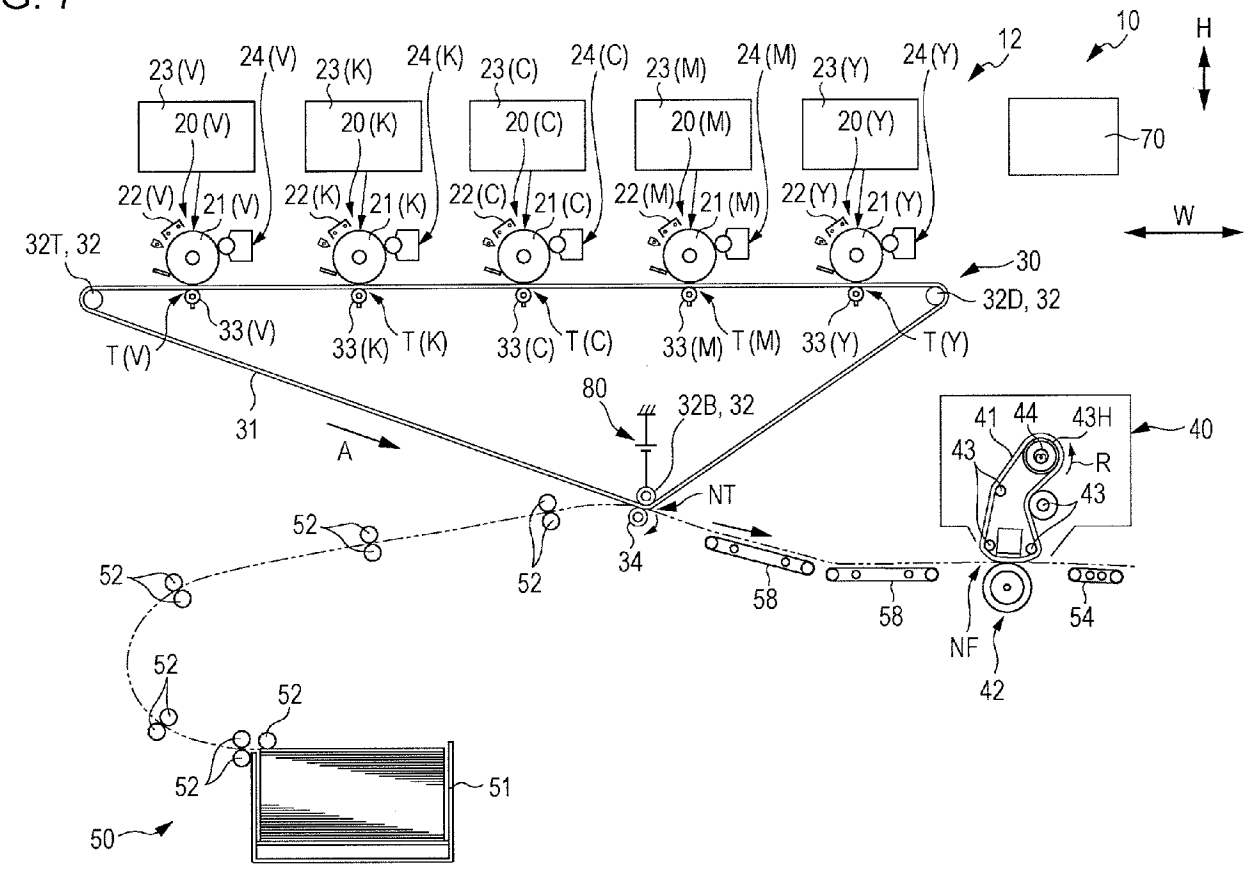
FIG. 7 schematically illustrates an image forming apparatus according to a second exemplary embodiment.

Referring to FIG. 7, in the image forming section 12 according to this exemplary embodiment, the toner-image forming units 20 are arranged from the upstream side toward the downstream side in the transporting direction of the transfer belt 31 in the following order: yellow (Y), magenta (M), cyan (C), black (K), special color (V).

Figure 8A:
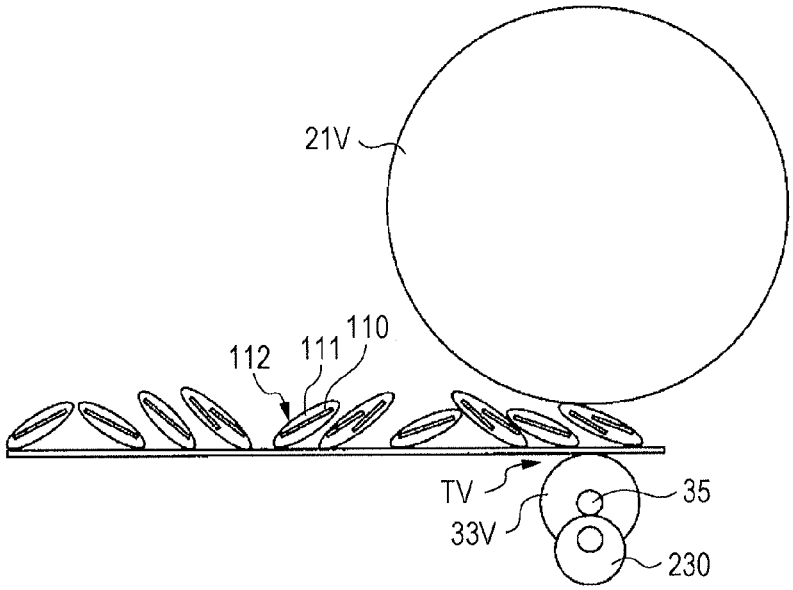
FIGS. 8A and 8B schematically illustrate a configuration in which a nip load of a first-transfer roller according to the second exemplary embodiment is adjustable.

Furthermore, in this exemplary embodiment, the nip load for nipping the transfer belt 31 between the first-transfer roller 33V (an example of a second transfer member) and the photoconductor drum 21V is adjustable. Specifically, as shown in FIGS. 8A and 8B, the center distance between the first-transfer roller 33V and the photoconductor drum 21V is adjustable by a cam 230 that is rotated by a driver (not shown).

Figure 8B:
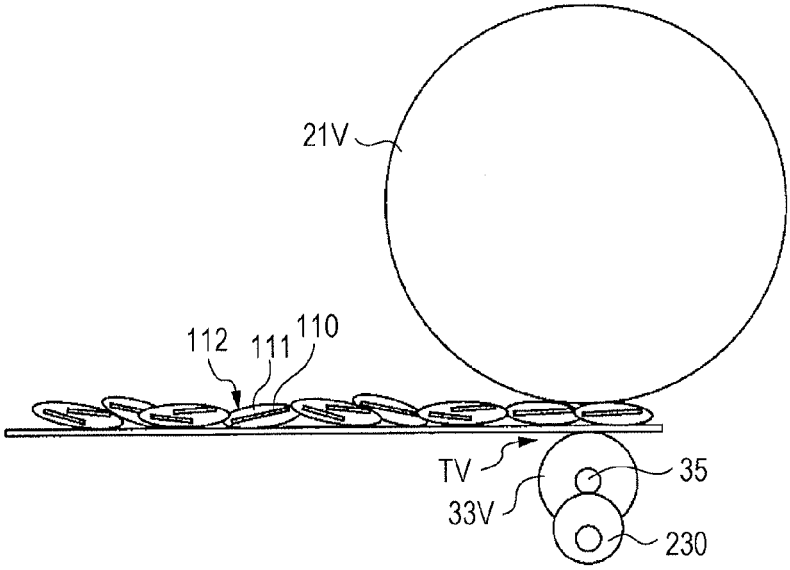

More specifically, as shown in FIG. 8B, the cam 230 stops at a rotational position where a large-diameter portion of the cam 230 comes into contact with the shaft 35 of the first-transfer roller 33V so that the first-transfer roller 33V nips the transfer belt 31 in cooperation with the photoconductor drum 21V with the second nip load, which is larger than the first nip load in the first-transfer rollers 33Y to 33K. As shown in FIG. 8A, the cam 230 stops at a rotational position where a small-diameter portion of the cam 230 comes into contact with the shaft 35 of the first-transfer roller 33V so that the first-transfer roller 33V nips the transfer belt 31 in cooperation with the photoconductor drum 21V with a third nip load, which is smaller than the second nip load.

In this exemplary embodiment, the first nip load is set to, for example, 13 g/cm (linear pressure). The second nip load is set to, for example, 20 g/cm (linear pressure). The third nip load is set to, for example, 17 g/cm (linear pressure), which is larger than the first nip load. Alternatively, the third nip load may be set equal to the first nip load.

In this exemplary embodiment, the image forming apparatus 10 has a first mode that uses the second nip load and a second mode that uses the third nip load, which is smaller than the second nip load. Specifically, in the first mode, a silver-color image is transferred onto the transfer belt 31 from the photoconductor drum 21V while nipping the transfer belt 31 between the first-transfer roller 33V and the photoconductor drum 21V with the second nip load. In the second mode, a silver-color image is transferred onto the transfer belt 31 from the photoconductor drum 21V while nipping the transfer belt 31 between the photoconductor drum 21V and the first-transfer roller 33V with the third nip load, which is smaller than the second nip load.

The first mode is selected and executed by the controller 70 when transferring a silver-color image onto the transfer belt 31 but not transferring color images onto the transfer belt 31. Specifically, the first mode is selected and executed by the controller 70 when the controller 70 receives an image formation command (silver-color-image formation command) for forming a silver-color image on a recording medium P without forming color images on the recording medium P.

The second mode is selected and executed by the controller 70 when transferring color images and a silver-color image onto the transfer belt 31. Specifically, the second mode is selected and executed by the controller 70 when the controller 70 receives an image formation command (mixed-color-image formation command) for forming a silver-color image and color images on a recording medium P.

Operation of Second Exemplary Embodiment

When the controller 70 receives a silver-color-image formation command, the controller 70 selects the first mode and activates the toner-image forming unit 20V (see FIG. 1). As a result of selecting the first mode, the cam 230 stops at the rotational position where the large-diameter portion of the cam 230 comes into contact with the shaft 35 of the first-transfer roller 33V, as shown in FIG. 8B. Thus, the first-transfer roller 33V nips the transfer belt 31 in cooperation with the photoconductor drum 21V with the second nip load, which is larger than the first nip load.

As a result of activating the toner-image forming unit 20V, a charging operation, an exposure operation, and a developing operation are performed by the charging device 22, the exposure device 23, and the developing device 24, respectively, in the toner-image forming unit 20V, so that a silver-color image is formed on the photoconductor drum 21V.

This silver-color image is transferred onto the transfer belt 31 at the first-transfer position TV. In this case, the silver-color image and the transfer belt 31 are nipped with the second nip load between the first-transfer roller 33V and the photoconductor drum 21V at the first-transfer position TV. The silver-color image transferred on the transfer belt 31 is transferred onto the recording medium P from the transfer belt 31 at the second-transfer position NT.

The recording medium P having the silver-color image transferred thereon is transported to the fixation nip NF of the fixing device 40. The fixing device 40 applies heat and pressure onto the recording medium P passing through the fixation nip NF. Thus, the silver-color image transferred on the recording medium P becomes fixed onto the recording medium P.

As described above, in this exemplary embodiment, when the silver-color image is to be transferred onto the transfer belt 31, the silver-color image and the transfer belt 31 are nipped with the second nip load, which is larger than the first nip load. Therefore, the silver-color toner particles in the silver-color image become closely in contact with one another in a laid state and clump together, as compared with a case where the silver-color image and the transfer belt 31 are nipped with the first nip load. Moreover, the contact area between the silver-color toner in the silver-color image and the transfer belt 31 increases, so that the adhesion strength (adhesiveness) between the silver-color toner and the transfer belt 31 increases, as compared with a case where the silver-color image and the transfer belt 31 are nipped with the first nip load.

Therefore, when the silver-color image is to be transferred onto the recording medium P from the transfer belt 31, even if the second-transfer roller 34 vibrates in the axial direction thereof, the pigment 110 of the silver-color toner may be less likely to move, so that a local change in the orientation of the pigment 110 may be less likely to occur.

Consequently, in the first mode, a periodical variation in the orientation of the pigment 110 contained in the silver-color toner of the silver-color image transferred on the recording medium P from the transfer belt 31 may be suppressed, as compared with a case where the nip load at the first-transfer position TV is smaller than or equal to the first nip load. Thus, nonuniform metallic luster may be suppressed in the silver-color image formed on the recording medium P.

When the controller 70 receives a mixed-color-image formation command, the controller 70 selects the second mode and activates the toner-image forming units 20V and 20Y to 20K (see FIG. 1). As a result of selecting the second mode, the cam 230 stops at the rotational position where the small-diameter portion of the cam 230 comes into contact with the shaft 35 of the first-transfer roller 33V, as shown in FIG. 8A. Thus, the first-transfer roller 33V nips the transfer belt 31 in cooperation with the photoconductor drum 21V with the third nip load, which is smaller than the second nip load.

As a result of activating the toner-image forming units 20V and 20Y to 20K, a charging operation, an exposure operation, and a developing operation are performed by the charging devices 22, the exposure devices 23, and the developing devices 24, respectively, in the toner-image forming units 20V and 20Y to 20K, so that a silver-color image and color images are formed on the photoconductor drums 21V and 21Y to 21K.

The color images formed on the photoconductor drums 21Y to 21K are sequentially transferred onto the transfer belt 31 at the first-transfer positions TY to TK. In this case, the color images and the transfer belt 31 are nipped with the first nip load between the first-transfer rollers 33Y to 33K and the photoconductor drums 21Y to 21K at the first-transfer positions TY to TK.

Furthermore, the silver-color image formed on the photoconductor drum 21V is transferred onto the transfer belt 31 at the first-transfer position TV. In this case, the silver-color image and the transfer belt 31 are nipped with the third nip load between the first-transfer roller 33V and the photoconductor drum 21V at the first-transfer position TV. Moreover, the color images transferred on the transfer belt 31 are nipped with the third nip load between the first-transfer roller 33V and the photoconductor drum 21V when the color images pass through the first-transfer position TV.

Then, the color images and the silver-color image transferred on the transfer belt 31 are transferred onto the recording medium P from the transfer belt 31 at the second-transfer position NT.

The recording medium P having the color images and the silver-color image transferred thereon is transported to the fixation nip NF of the fixing device 40. The fixing device 40 applies heat and pressure onto the recording medium P passing through the fixation nip NF. Thus, the color images and the silver-color image transferred on the recording medium P become fixed onto the recording medium P.

In this exemplary embodiment, when the color images are to be transferred onto the transfer belt 31, the color images and the transfer belt 31 are nipped with the first nip load, which is smaller than the second nip load. Furthermore, the color images transferred on the transfer belt 31 are nipped with the third nip load between the first-transfer roller 33V and the photoconductor drum 21V when the color images pass through the first-transfer position TV.

Therefore, the color toner particles in the color images do not become closely in contact with one another and are prevented from clumping together on the transfer belt 31, as compared with a case where the color images and the transfer belt 31 are nipped with the second nip load at the first-transfer position TV. Moreover, the adhesion strength (adhesiveness) between the color toners of the color images and the transfer belt 31 is lower than in a case where the color images and the transfer belt 31 are nipped with the second nip load.

Therefore, when the color images are transferred onto the recording medium P from the transfer belt 31, a situation where the color toners remain on the transfer belt 31 without being transferred onto the recording medium P may be suppressed, so that missing images on the recording medium P may be suppressed.

Third Exemplary Embodiment

Next, an image forming apparatus according to a third exemplary embodiment will be described. Components similar to those in the second exemplary embodiment will be given the same reference characters, and descriptions thereof will be omitted.

Configuration of Third Exemplary Embodiment

The image forming section 12 according to this exemplary embodiment is similar to that in the second exemplary embodiment in that the toner-image forming units 20 are arranged from the upstream side toward the downstream side in the transporting direction of the transfer belt 31 in the following order: yellow (Y), magenta (M), cyan (C), black (K), special color (V) (see FIG. 7).

In the second exemplary embodiment described above, the second mode is selected and executed by the controller 70 when transferring color images and a silver-color image onto the transfer belt 31.

In contrast, in the third exemplary embodiment, when color images and a silver-color image are transferred onto the transfer belt 31 and the silver-color image has an area coverage of 95% or higher and occupies 50% or more of the width of the recording medium P (see a region RB surrounded by a dashed line in FIG. 9), the first mode is selected and executed by the controller 70.

Furthermore, when color images and a silver-color image are transferred onto the transfer belt 31 and the silver-color image has an area coverage of 95% or higher and occupies less than 50% of the width of the recording medium P (see a region RA surrounded by a dashed line in FIG. 9), the second mode is selected and executed by the controller 70.

When the controller 70 receives a mixed-color-image formation command, the controller 70 determines based on job data whether or not a silver-color image with an area coverage of 95% or higher occupies 50% or more of the width of the recording medium P. Specifically, based on the job data, the controller 70 determines whether or not the ratio of an image width within which the silver-color image with the area coverage of 95% or higher is to be formed to a medium width of the recording medium P on which an image is to be actually formed is 50% or more.

The area coverage refers to the percentage of the number of pixels in the toner image to be developed by the developing device 24 relative to the total number of pixels included per unit area when an exposure dot to be formed on the photoconductor drum 21 by the exposure device 23 is defined as one pixel.

The image width is the maximum width of the silver-color image in the width direction of the recording medium P. The medium width is the maximum width of the recording medium P on which an image is to be actually formed.

As a result of the above determination process, if the silver-color image with the area coverage of 95% occupies 50% or more of the width of the recording medium P, the controller 70 selects and executes the first mode. If the silver-color image with the area coverage of 95% occupies less than 50% of the width of the recording medium P as a result of the above determination process, the controller 70 selects and executes the second mode. If the silver-color image only includes an image with an area coverage lower than 95% (see a region RC surrounded by a dashed line in FIG. 9), the controller 70 selects and executes the second mode.

If the area coverage of the toner image to be formed on the recording medium P is high and the toner image has a large image width, the adhesion strength between the transfer belt 31 and the recording medium P decreases, causing the recording medium P to move relatively to the transfer belt 31. Thus, a periodical variation in the orientation of the pigment 110 as shown in FIG. 5 tends to occur. Furthermore, if the area coverage of the toner image to be formed on the recording medium P is high and the toner image has a large image width, a periodical variation in the orientation of the pigment 110 in the silver-color toner tends to be visually recognized as non-uniform metallic luster when the orientation of the pigment 110 locally changes.

Figure 9:
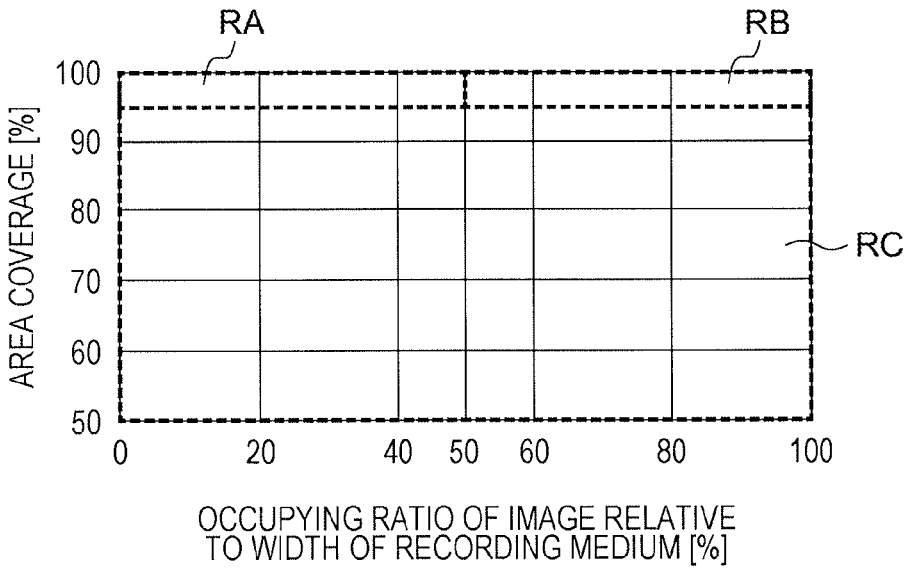
FIG. 9 is a graph illustrating conditions (including an area coverage and an occupying ratio of an image relative to the width of the recording medium) for selecting modes.

The present inventor has discovered that the recording medium P tends to move relatively to the transfer belt 31 and the periodical variation in the orientation of the pigment 110 in the silver-color toner tends to be visually recognized as nonuniform metallic luster especially when the silver-color image with the area coverage of 95% or higher occupies 50% or more of the width of the recording medium P (see the region RB surrounded by a dashed line in FIG. 9).

Operation of Third Exemplary Embodiment

When the controller 70 receives a mixed-color-image formation command, the controller 70 determines based on job data whether or not the ratio of the image width within which the silver-color image with the area coverage of 95% or higher is to be formed to the medium width of the recording medium P on which an image is to be actually formed is 50% or more.

As a result of the above determination process, if the silver-color image with the area coverage of 95% occupies 50% or more of the width of the recording medium P, the controller 70 selects the first mode and activates the toner-image forming unit 20V (see FIG. 1).

As a result of selecting the first mode, the cam 230 stops at the rotational position where the large-diameter portion of the cam 230 comes into contact with the shaft 35 of the first-transfer roller 33V, as shown in FIG. 8B. Thus, the first-transfer roller 33V nips the transfer belt 31 in cooperation with the photoconductor drum 21V with the second nip load, which is larger than the first nip load.

As a result of activating the toner-image forming unit 20V, a charging operation, an exposure operation, and a developing operation are performed by the charging device 22, the exposure device 23, and the developing device 24, respectively, in the toner-image forming unit 20V, so that a silver-color image is formed on the photoconductor drum 21V.

This silver-color image is transferred onto the transfer belt 31 at the first-transfer position TV. In this case, the silver-color image and the transfer belt 31 are nipped with the second nip load between the first-transfer roller 33V and the photoconductor drum 21V at the first-transfer position TV. The silver-color image transferred on the transfer belt 31 is transferred onto the recording medium P from the transfer belt 31 at the second-transfer position NT.

The recording medium P having the silver-color image transferred thereon is transported to the fixation nip NF of the fixing device 40. The fixing device 40 applies heat and pressure onto the recording medium P passing through the fixation nip NF. Thus, the silver-color image transferred on the recording medium P becomes fixed onto the recording medium P.

As described above, in this exemplary embodiment, when the silver-color image is to be transferred onto the transfer belt 31, the silver-color image and the transfer belt 31 are nipped with the second nip load, which is larger than the first nip load. Therefore, the silver-color toner particles in the silver-color image become closely in contact with one another in a laid state and clump together, as compared with a case where the silver-color image and the transfer belt 31 are nipped with the first nip load. Moreover, the contact area between the silver-color toner in the silver-color image and the transfer belt 31 increases, so that the adhesion strength (adhesiveness) between the silver-color toner and the transfer belt 31 increases, as compared with a case where the silver-color image and the transfer belt 31 are nipped with the first nip load.

Therefore, when the silver-color image is to be transferred onto the recording medium P from the transfer belt 31, even if the second-transfer roller 34 vibrates in the axial direction thereof, the pigment 110 of the silver-color toner may be less likely to move, so that a local change in the orientation of the pigment 110 may be less likely to occur.

Consequently, in the first mode, a periodical variation in the orientation of the pigment 110 contained in the silver-color toner of the silver-color image transferred on the recording medium P from the transfer belt 31 may be suppressed, as compared with a case where the nip load at the first-transfer position TV is smaller than or equal to the first nip load. Thus, nonuniform metallic luster may be suppressed in the silver-color image formed on the recording medium P.

As a result of the determination process for determining whether or not the ratio of the image width with respect to the silver-color image with the area coverage of 95% or higher to the medium width of the recording medium P is 50% or more, if the silver-color image with the area coverage of 95% or higher occupies less than 50% of the width of the recording medium P, the controller 70 selects the second mode and activates the toner-image forming units 20V and 20Y to 20K (see FIG. 1).

As a result of selecting the second mode, the cam 230 stops at the rotational position where the small-diameter portion of the cam 230 comes into contact with the shaft 35 of the first-transfer roller 33V, as shown in FIG. 8A. Thus, the first-transfer roller 33V nips the transfer belt 31 in cooperation with the photoconductor drum 21V with the third nip load, which is smaller than the second nip load.

As a result of activating the toner-image forming units 20V and 20Y to 20K, a charging operation, an exposure operation, and a developing operation are performed by the charging devices 22, the exposure devices 23, and the developing devices 24, respectively, in the toner-image forming units 20V and 20Y to 20K, so that a silver-color image and color images are formed on the photoconductor drums 21V and 21Y to 21K.

The color images formed on the photoconductor drums 21Y to 21K are sequentially transferred onto the transfer belt 31 at the first-transfer positions TY to TK. In this case, the color images and the transfer belt 31 are nipped with the first nip load between the first-transfer rollers 33Y to 33K and the photoconductor drums 21Y to 21K at the first-transfer positions TY to TK.

Furthermore, the silver-color image formed on the photoconductor drum 21V is transferred onto the transfer belt 31 at the first-transfer position TV. In this case, the silver-color image and the transfer belt 31 are nipped with the third nip load between the first-transfer roller 33V and the photoconductor drum 21V at the first-transfer position TV. Moreover, the color images transferred on the transfer belt 31 are nipped with the third nip load between the first-transfer roller 33V and the photoconductor drum 21V when the color images pass through the first-transfer position TV.

Then, the color images and the silver-color image transferred on the transfer belt 31 are transferred onto the recording medium P from the transfer belt 31 at the second-transfer position NT.

The recording medium P having the color images and the silver-color image transferred thereon is transported to the fixation nip NF of the fixing device 40. The fixing device 40 applies heat and pressure onto the recording medium P passing through the fixation nip NF. Thus, the color images and the silver-color image transferred on the recording medium P become fixed onto the recording medium P.

In this exemplary embodiment, when the color images are to be transferred onto the transfer belt 31, the color images and the transfer belt 31 are nipped with the first nip load, which is smaller than the second nip load. Furthermore, the color images transferred on the transfer belt 31 are nipped with the third nip load between the first-transfer roller 33V and the photoconductor drum 21V when the color images pass through the first-transfer position TV.

Therefore, the color toner particles in the color images do not become closely in contact with one another and are prevented from clumping together on the transfer belt 31, as compared with a case where the color images and the transfer belt 31 are nipped with the second nip load at the first-transfer position TV. Moreover, the adhesion strength (adhesiveness) between the color toners of the color images and the transfer belt 31 is lower than in a case where the color images and the transfer belt 31 are nipped with the second nip load.

Therefore, when the color images are transferred onto the recording medium P from the transfer belt 31, a situation where the color toners remain on the transfer belt 31 without being transferred onto the recording medium P may be suppressed, so that missing images on the recording medium P may be suppressed.

Modifications of Third Exemplary Embodiment

In the third exemplary embodiment, the controller 70 selects a mode based on the ratio of the image width with respect to the silver-color image with the area coverage of 95% or higher to the medium width of the recording medium P. Alternatively, for example, the controller 70 may select a mode based on whether or not the image width with respect to the silver-color image with the area coverage of 95% or higher is larger than or equal to a predetermined width (e.g., 148.5 mm (i.e., 50% of the width of an A3-size sheet)).

Furthermore, in the third exemplary embodiment, the toner-image forming units 20 are arranged from the upstream side toward the downstream side in the transporting direction of the transfer belt 31 in the following order: yellow (Y), magenta (M), cyan (C), black (K), special color (V) (see FIG. 7). Alternatively, for example, the toner-image forming units 20 may be arranged from the upstream side toward the downstream side in the transporting direction of the transfer belt 31 in the following order: special color (V), yellow (Y), magenta (M), cyan (C), black (K). The arranged order of the toner-image forming units 20 is not limited.

Modifications of First to Third Exemplary Embodiments

In the first to third exemplary embodiments described above, the silver-color toner is used as a toner that contains a flat pigment. Alternatively, a metallic-color toner, such as a gold-color toner, may be used. A gold-color toner contains, for example, a flat pigment composed of aluminum, as well as a yellow pigment. In other words, the toner that contains the flat pigment may contain a pigment other than the flat pigment.

The present invention is not limited to the above exemplary embodiments and permits various modifications, alterations, and changes so long as they do not depart from the scope of the invention. For example, with regard to the modifications described above, multiple modifications may be appropriately combined.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first forming unit that forms a first image by using a toner that contains a pigment other than a flat pigment;

a second forming unit that forms a second image by using a toner that contains a flat pigment;

a transfer body that transports the first image and the second image transferred thereon and transfers the first image and the second image onto a recording medium;

a first transfer member that nips the transfer body in cooperation with the first forming unit with a first load and transfers the first image from the first forming unit onto the transfer body; and a second transfer member that nips the transfer body in cooperation with the second forming unit with a second load, which is larger than the first load, and transfers the second image from the second forming unit onto the transfer body.

2. An image forming apparatus comprising:

a first forming unit that forms a first image by using a toner that contains a pigment other than a flat pigment;

a second forming unit that forms a second image by using a toner that contains a flat pigment;

a transfer body that transports the first image and the second image transferred thereon and transfers the first image and the second image onto a recording medium;

a first transfer member that nips the transfer body in cooperation with the first forming unit with a first load and transfers the first image from the first forming unit onto the transfer body; and a second transfer member that nips the transfer body in cooperation with the second forming unit with a second load, which is larger than the first load, and transfers the second image from the second forming unit onto the transfer body in a first mode, and that nips the transfer body in cooperation with the second forming unit with a third load, which is smaller than the second load, and transfers the second image from the second forming unit onto the transfer body in a second mode.

3. The image forming apparatus according to claim 2, wherein the second forming unit and the second transfer member are disposed downstream of the first forming unit and the first transfer member in a transporting direction of the transfer body, wherein the first mode corresponds to a case where the first image is not transferred onto the transfer body and the second mode is transferred onto the transfer body, and wherein the second mode corresponds to a case where the first image and the second image are transferred onto the transfer body.

4. The image forming apparatus according to claim 2, wherein the first mode corresponds to a case where the first image and the second image are transferred onto the transfer body and the second image has an area coverage of 95% or higher and occupies 50% or more of a width of the recording medium, and wherein the second mode corresponds to a case where the first image and the second image are transferred onto the transfer body and the second image having the area coverage of 95% or higher occupies less than 50% of the width of the recording medium.

* * * * *